United States Patent [19]

Aivaliotis et al.

[11] Patent Number: 5,076,136

[45] Date of Patent: Dec. 31, 1991

[54] ELECTROMAGNETIC LAUNCHER SYSTEM

[75] Inventors: Emmanuel Aivaliotis; Bobby D. McKee, both of San Jose, Calif.

[73] Assignee: Westinghouse Electric Corp., Pittsburgh, Pa.

[21] Appl. No.: 199,496

[22] Filed: May 27, 1988

[51] Int. Cl.[5] ..... F41B 6/00

[52] U.S. Cl. ..... 89/8; 89/1.703; 124/3

[58] Field of Search ..... 89/8, 1.7, 1.701, 1.703; 124/3

[56] References Cited

U.S. PATENT DOCUMENTS

| | | | |
|---|---|---|---|
| H357 | 11/1987 | Howland et al. | 89/8 |
| 421,307 | 2/1890 | Reynolds | 89/7 |
| 3,380,340 | 4/1968 | Bergman et al. | 89/1.703 |
| 4,369,692 | 1/1983 | Kemeny | 89/8 |
| 4,527,457 | 7/1985 | Fikse | 89/8 |
| 4,534,263 | 8/1985 | Heyne et al. | 89/8 |
| 4,676,136 | 6/1987 | Kalin | 89/1.703 |

FOREIGN PATENT DOCUMENTS

| | | | |
|---|---|---|---|
| 2467 | 4/1988 | European Pat. Off. | 124/3 |
| 3503040 | 7/1986 | Fed. Rep. of Germany | 89/1.703 |

OTHER PUBLICATIONS

Good et al., Ammunition, "Cartridge Cases", 1982, pp. 184–185.

*Primary Examiner*—Stephen C. Bentley
*Attorney, Agent, or Firm*—D. Schron

[57] ABSTRACT

Electromagnetic launcher apparatus which includes a set of projectile rails and a set of switch rails both lying along a common longitudinal axis. An armature assembly includes at one end thereof a switching armature for conduction of current between the switching rails, and at the other end thereof a projectile armature for conduction of current between the projectile rails. The rail system is supplied with operating current and when a predetermined current level is obtained, the armature assembly separates such that the armatures are propelled in opposite directions. The rearwardly projected switch armature may be intercepted by a stop mechanism while the forwardly projected armature propels a payload such as a projectile.

8 Claims, 7 Drawing Sheets

ELECTROMAGNETIC LAUNCHER SYSTEM

BACKGROUND OF THE INVENTION

1. Field of the Invention

The invention in general relates to electromagnetic projectile launchers, and particularly to an improved switching system therefore.

2. Background Information

One type of electromagnetic launcher known as a railgun, basically consists of a power supply and two generally parallel electrically conducting rails between which is positioned an electrically conducting armature. Current from the power supply is commutated into the rail system and flows down one rail, through the armature and back along the other rail whereby a force is exerted on the armature to accelerate it, and a payload, so as to attain a desired muzzle, or exit velocity. Current conduction between the parallel rails may be accomplished by a metallic armature or alternatively by an armature in the form of a plasma or arc which creates an accelerating force on the rear of a sabot which in the bore length supports and accelerates the projectile.

Electromagnetic launchers have been built with power supplies which deliver hundreds of thousands or even millions of amperes in order to obtain a predetermined exit velocity. A variety of switches may be used for commutating the high current into the rail system, and as will be described, the switches can be bulky and expensive with a limited life cycle not conducive to rapid fire operation.

It is a primary object of the present invention to provide an electromagnetic launcher system having an improved switching arrangement for commutating high current into the projectile rails and which lends itself to rapid fire operation.

SUMMARY OF THE INVENTION

The electromagnetic projectile launcher apparatus of the present invention includes a first set of first and second generally parallel rails constituting projectile rails as well as a second set of first and second generally parallel rails constituting switch rails. The first and second sets of rails lie along a common longitudinal axis and an armature assembly is provided which includes a first current conducting armature positioned between the projectile rails as well as a second current conducting armature positioned between the switch rails with the armatures being separably connected. Means are provided for delivering a high current to the first and second sets of rails whereby the armatures are relatively forced in opposite directions but are held in place until such time that the supply current reaches a predetermined value to cause separation of the armatures whereby they are propelled in opposite directions along the axis. The first armature may be operable to propel a projectile out the muzzle end of the first set of rails while the second armature, propelled in an opposite direction may, if desired, be limited in its rearward movement by means of a stop assembly.

DESCRIPTION OF THE PREFERRED EMBODIMENTS

Figure 1:
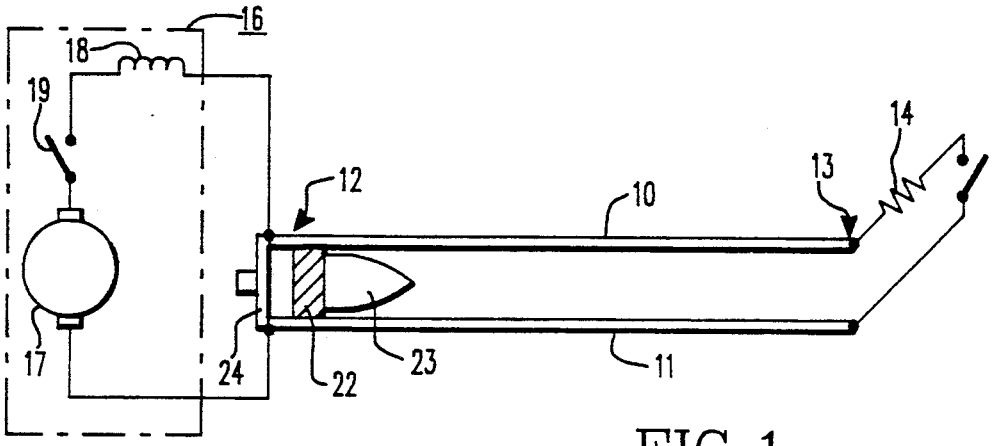
FIG. 1 PRIOR ART
FIGS. 1 and 2 illustrate typical electromagnetic launcher systems with two different switch arrangements.

Referring now to FIG. 1, there is illustrated a typical electromagnetic launcher including first and second generally parallel rail members 10 and 11 having a breech end 12 and a muzzle end 13 at which is located a closable muzzle switch resistor arrangement 14 whereby post-launch inductive energy remaining in the rail system may be dissipated. The rails of the launcher, as well as those launchers to be described, are generally positioned within an insulated containment structure, not illustrated. The breech end 12 is connected to a high current source 16 which includes a homopolar generator 17 connected in series with a inductive energy storage device in the form of inductor 18, the series connection being made upon closure of switch 19.

When the homopolar generator 17 (connected to a prime mover, not illustrated) attains a predetermined rotational speed, all or a fraction of the kinetic energy thereof is transferred to the inductor 18, when switch 19 is closed, and is then temporarily stored as electrical energy in inductor 18. During the inductor charging cycle, firing switch 24 connected to the breech end 12 remains in a closed condition. When the inductor current magnitude reaches an appropriate firing level, switch 24 is opened and current is commutated into rails 10 and 11 bridged by an electrically conducting armature 22 which propels a projectile 23.

Upon opening of firing switch 24, current flows down one rail, through the armature 22 and back along the other rail such that the current flowing in the loop exerts a force on the armature 22 to accelerate it, and projectile 23 with a force which in essence is a function of the magnetic flux density and current density vectors.

Typical electromagnetic launchers operate at peak current magnitudes on the order of several hundred thousand to several million amperes. In the current commutation operation, somewhere in the order of 1–2% of the inductively stored energy is dissipated in arcing at the firing switch contacts by the as yet non-commutated fraction of the current. The commutation or injection of current into the rails is driven by the resulting switch arc voltage, however, the arcing results in serious switch contact melting and insulating material loss such as to severely limit the useful life of the firing switch.

Figure 2:
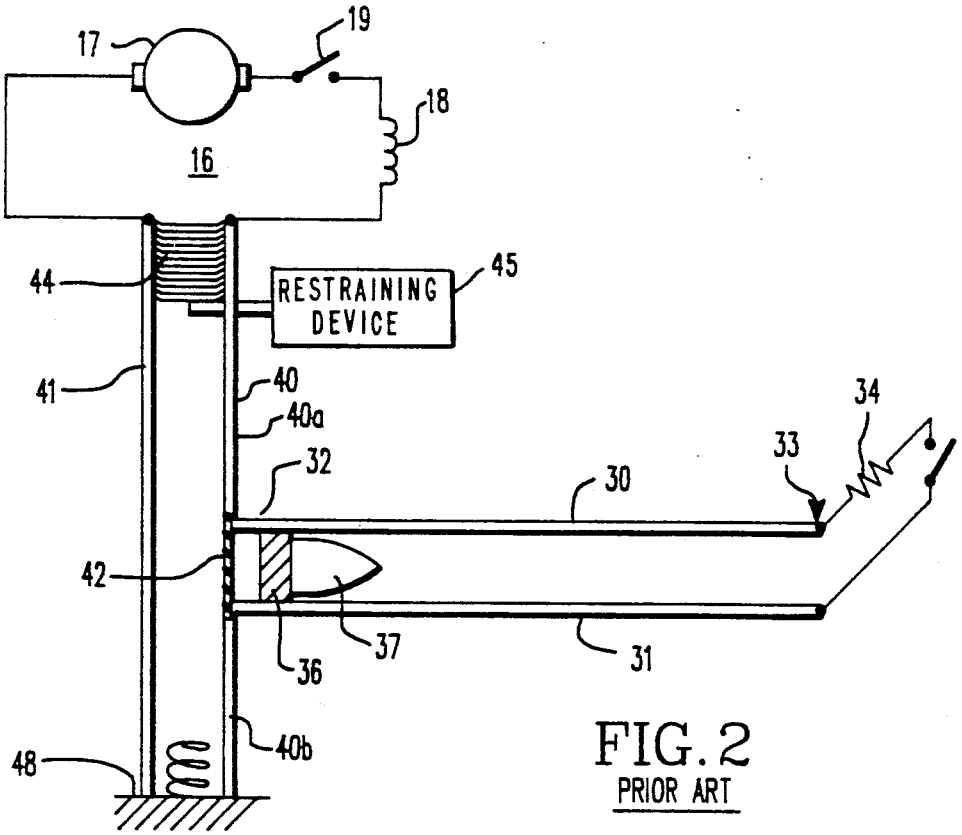
FIG. 2 PRIOR ART

FIG. 2 illustrates the basics of another type of switching arrangement. The launcher portion includes a first set of electrically conducting generally parallel rails 30 and 31 having a breech end 32 and a muzzle end 33 to which is connected a closable muzzle switch arrangement 34. An electrically conducting armature 36 bridges the rails 30 and 31 for accelerating a projectile 37 to a desired muzzle velocity.

The switching portion of the system includes a second set of electrically conducting generally parallel rails 40 and 41 with the second set being at right angles to the first set of rails 30, 31. Rail 30 is electrically connected to rail segment 40*a* while rail 31 is electrically connected to rail segment 40*b* with the rail segments 40*a* and 40*b* being connected by means of an insulating insert 42 which bridges and closes off the breech end of rails 30 and 31.

An armature 44 bridges rails 40 and 41 and is restrained from movement during the inductor 18 charging cycle by means of restraining device 45. When the desired firing level is attained, restraining device 45 disengages armature 44 which, upon release, is electromagnetically propelled between rails 40 and 41. During its course of travel, an arc is drawn after the armature 44 traverses insert 42 thus commutating the current into the first set of rails to accelerate armature 36. At the end of its travel, armature 44 is decelerated such as by a kinetic energy absorbing means 48.

Switching arrangements such as typified by FIG. 2 do not lend themselves to rapid fire operation in that the switching armature 44 which is decelerated by kinetic energy absorbing means 48 must thereafter be returned to its starting position and restrained in preparation for the next firing. Further, such armatures have a limited life. In addition to the limitations of the rail switching arrangement for rapid fire operation, such configurations tend to be bulky and expensive.

Figure 3A:
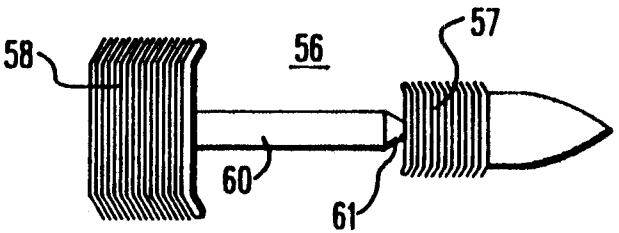
FIG. 3A illustrates an armature assembly itself.
Figure 3:
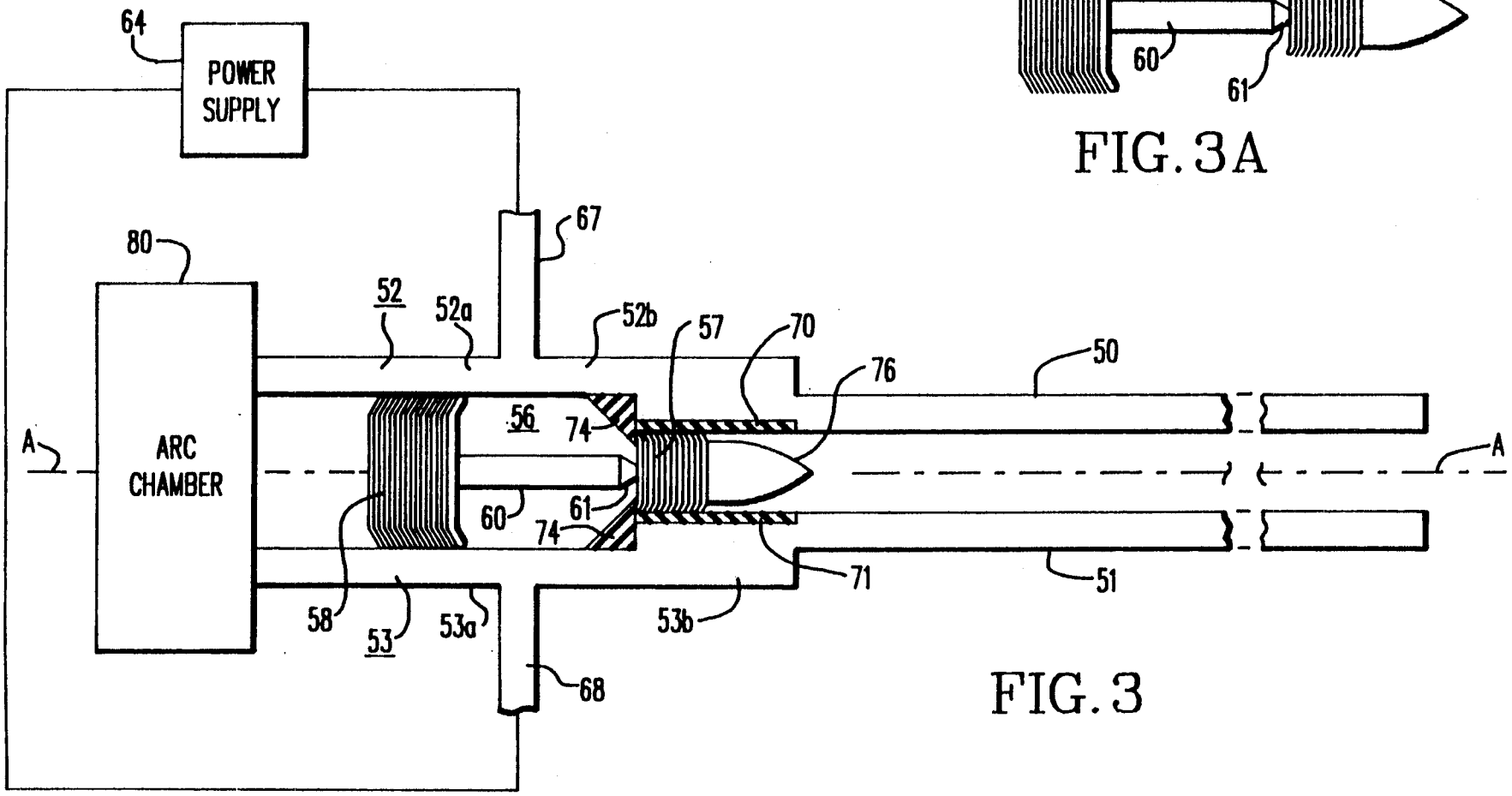
FIG. 3 illustrates one embodiment of the present invention.

FIG. 3 illustrates an improved electromagnetic launcher system in accordance with one embodiment of the present invention. The apparatus includes a first set of first and second generally parallel rails 50 and 51 constituting projectile rails and a second set of first and second generally parallel rails 52 and 53 constituting switch rails.

The arrangement includes an insertable armature assembly 56 which includes a first current conducting armature 57 positioned between projectile rails 50 and 51, and a second current conducting armature 58 positioned between switch rails 52 and 53. Typically, the armatures 57 and 58 may be made up of wafers of conductive material bent so as to supply a spring force against their respective rails for better sliding electrical contact. The armature assembly 56 additionally includes an elongated rod 60 joining the two armatures 57 and 58 with the rod having a neck down or weakened portion 61 where it joins with armature 57. The armature assembly 56 (also shown by itself in FIG. 3A), projectile rails 50 and 51 and switch rails 52 and 53 all lie along a common longitudinal axis AA.

A power supply 64 connected to the rails by means of busbars 67 and 68 supplies a high current, the major portion of which traverses the larger armature 58 via switch rail segments 52*a*, 53*a* with the remainder traversing the smaller armature 57 via switch rail segments 52*b*, 53*b*. In order to limit current flow through armature 57, resistive inserts 70 and 71 may be provided in the projectile rails 50 and 51, respectively. The electromagnetic forces acting on the armatures tend to force them in opposite directions along the axis AA. With the major portion of the current traversing armature 58, a greater force is acting to move the armature assembly to the left in FIG. 3 as opposed to the right. For this purpose a retaining means 74 is provided to prevent relative movement.

The weakened portion 61 of rod 60 is so designed such that when the current attains a predetermined value the rod will fracture at the weakened portion 61 thus allowing switch armature 58 to be propelled to the left while projectile armature 57 and projectile 76 are propelled to the right. Once the armature 57 is past resistive inserts 70 and 71, switch armature 58 will have left the rails 52 and 53 so that full power supply current is applied to armature 57 whereupon the launch of the projectile 76 takes place. Post launch inductive energy remaining in the rails may be dissipated in a muzzle resistor or may be recovered by any one of a number of well known recovery arrangements. An arc chamber 80 is provided to extinguish the arc which is formed as switch armature 58 exits the rail system 52, 53.

Figure 4A:
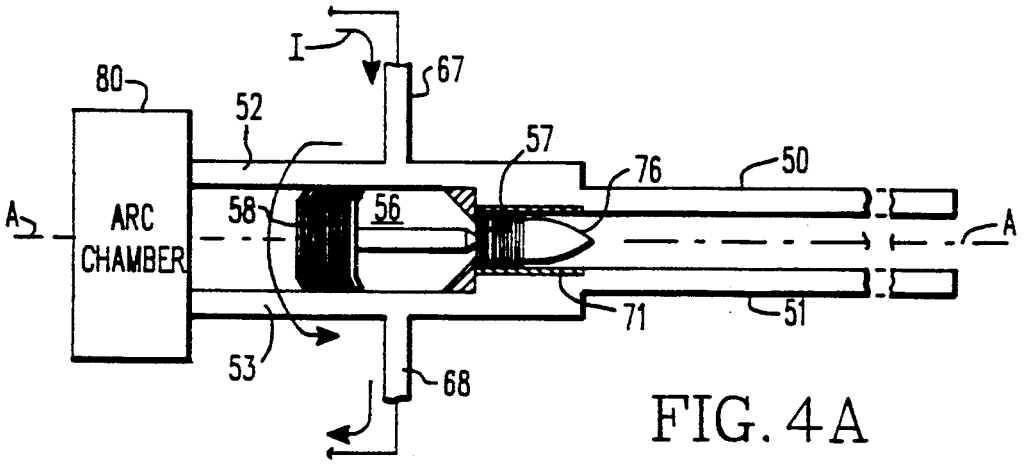
FIGS. 4A–4E illustrate the embodiment of FIG. 3 in a typical launch sequence.

The sequence of events for a launch is depicted in the simplified diagrams of FIGS. 4A–4E. FIG. 4A depicts the charging phase wherein essentially all of the current I provided by power supply 64 traverses switch armature 58 and thereafter completes the circuit back to power supply 64.

Figure 4B:
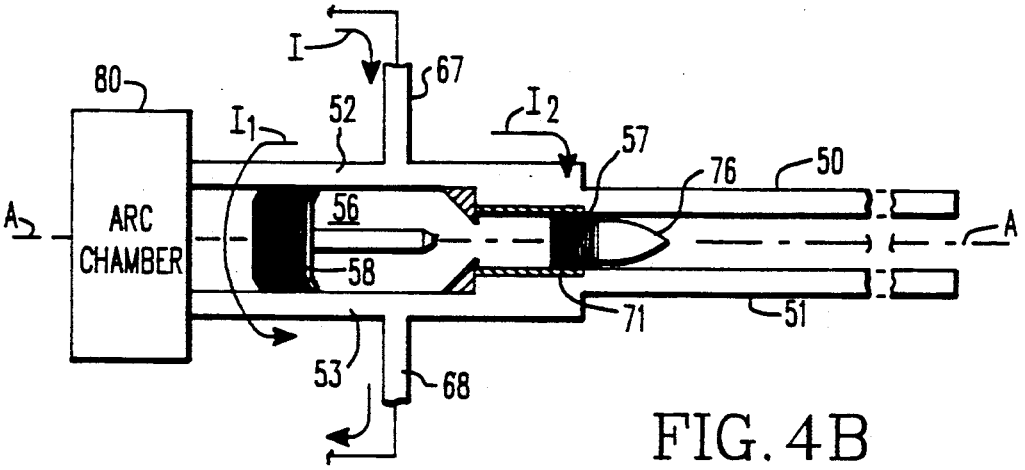

In FIG. 4B power supply current I is of a magnitude to cause fracture and separation and the current is split into switch armature current $I_1$ and projectile armature current $I_2$ where $I_1 > I_2$. If the inserts, 70 and 71 are electrically insulating inserts, then no current will traverse projectile armature 57 in which case the retaining means 74 will store energy as the force on switching armature 58 builds up. After fracture, the stored energy at retaining means 74 will propel projectile armature 57 past the inserts so as to accommodate current $I_2$.

Figure 4C:
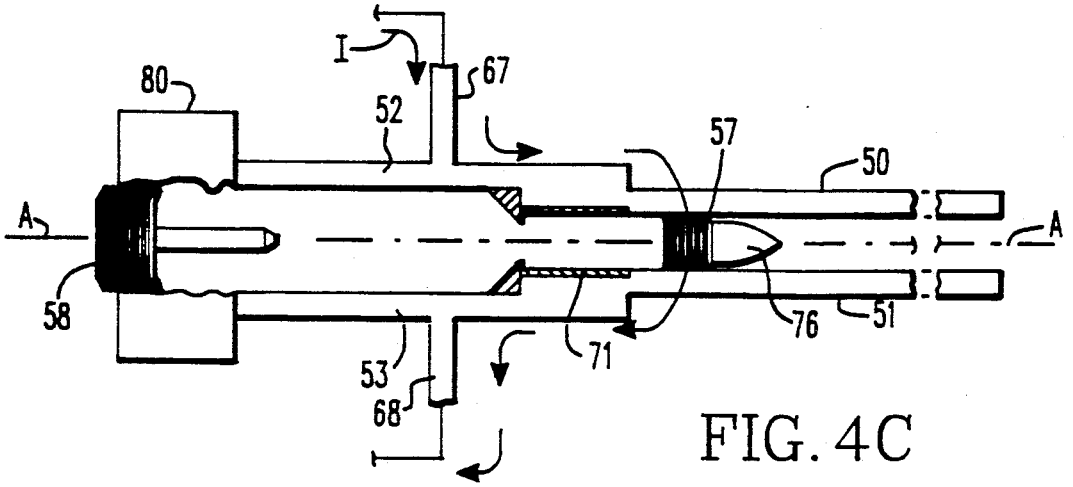
Figure 4D:
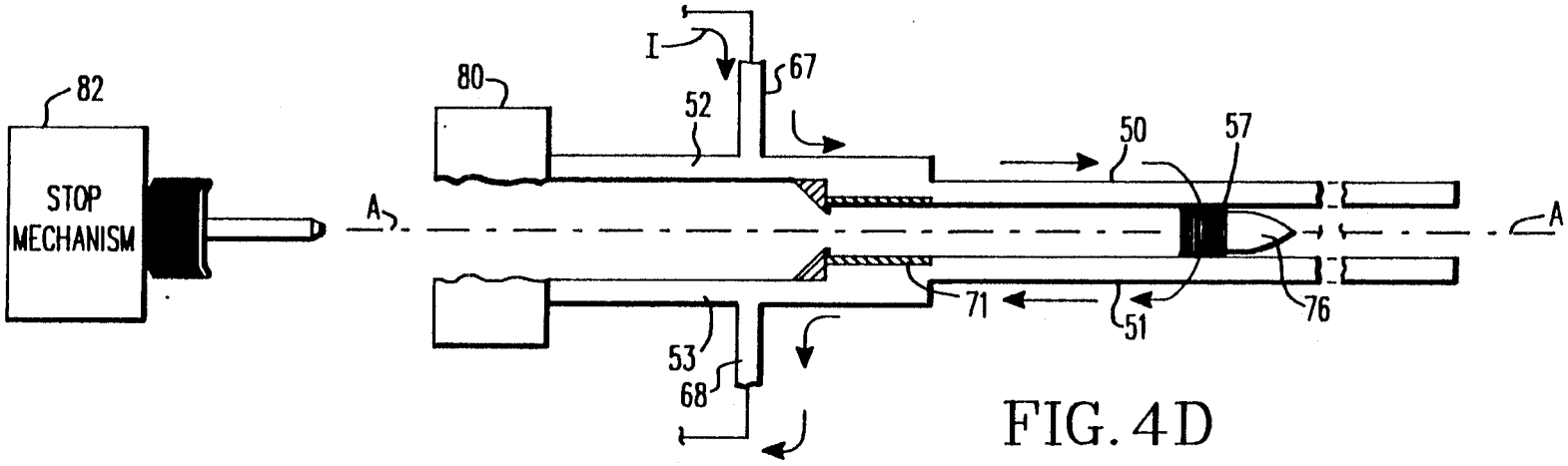

In FIG. 4C, switch armature 58 leaves rails 52, 53 and the total power supply current I is commutated into rails 50, 51 whereby the projectile launch proceeds as in FIG. 4D. In general, switch rails 52 and 53 will be of a much shorter length than projectile rails 50 and 51 so that switch armature 58 will not attain the same velocity as projectile armature 57. Accordingly, a stop mechanism 82 may be provided to prevent further rearward projection of the switch armature 58.

Figure 4E:
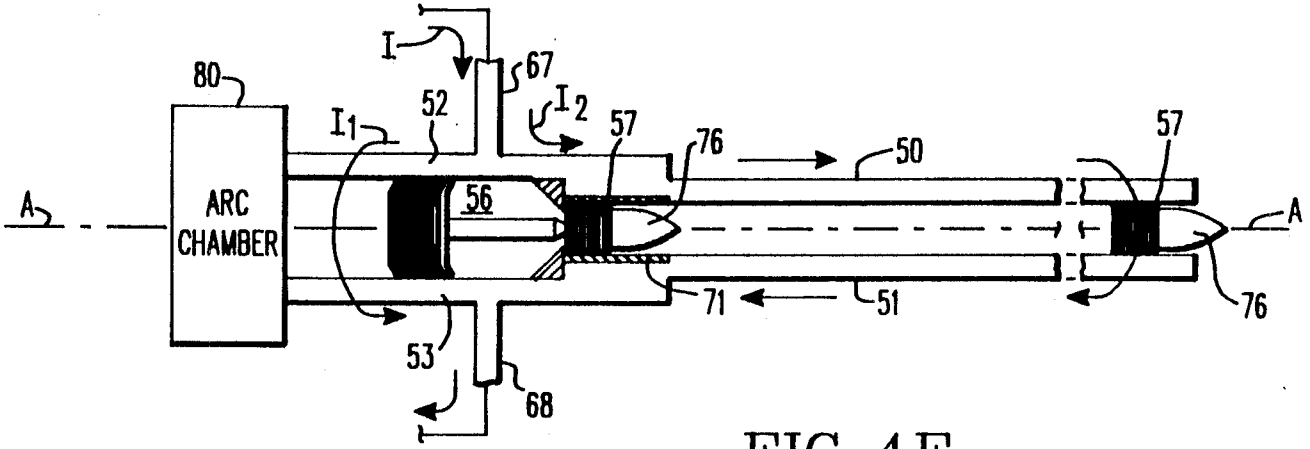
Figure 5:
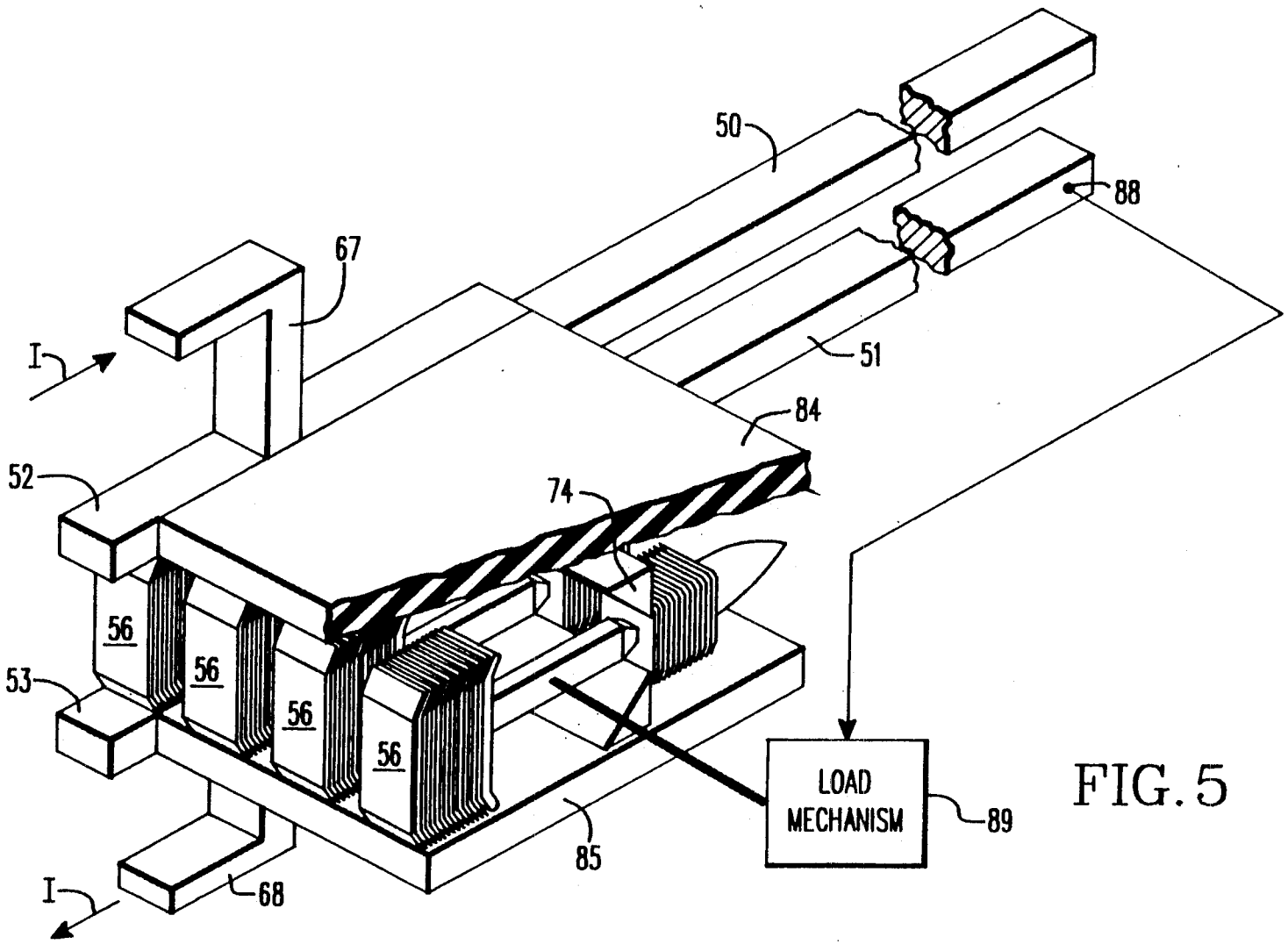
FIG. 5 illustrates an arrangement for rapid fire operation.

As the projectile exits the muzzle end of projectile rails 50 and 51, a muzzle switch (not illustrated) may be closed and a new armature assembly 56 inserted in preparation for the next firing, as indicated in FIG. 4E. In this regard, FIG. 5 illustrates a lateral loading arrangement whereby a plurality of insertable armature assemblies 56 are maintained in position between two electrically insulating support plates 84 and 85. A sensor 88 placed in the vicinity of the muzzle end of rails 50 and 51 is operable to provide an output signal upon projectile exit, with the output signal being operable to cause a loading mechanism 89 to mechanically insert another armature assembly 56 into a firing position.

Figure 6:
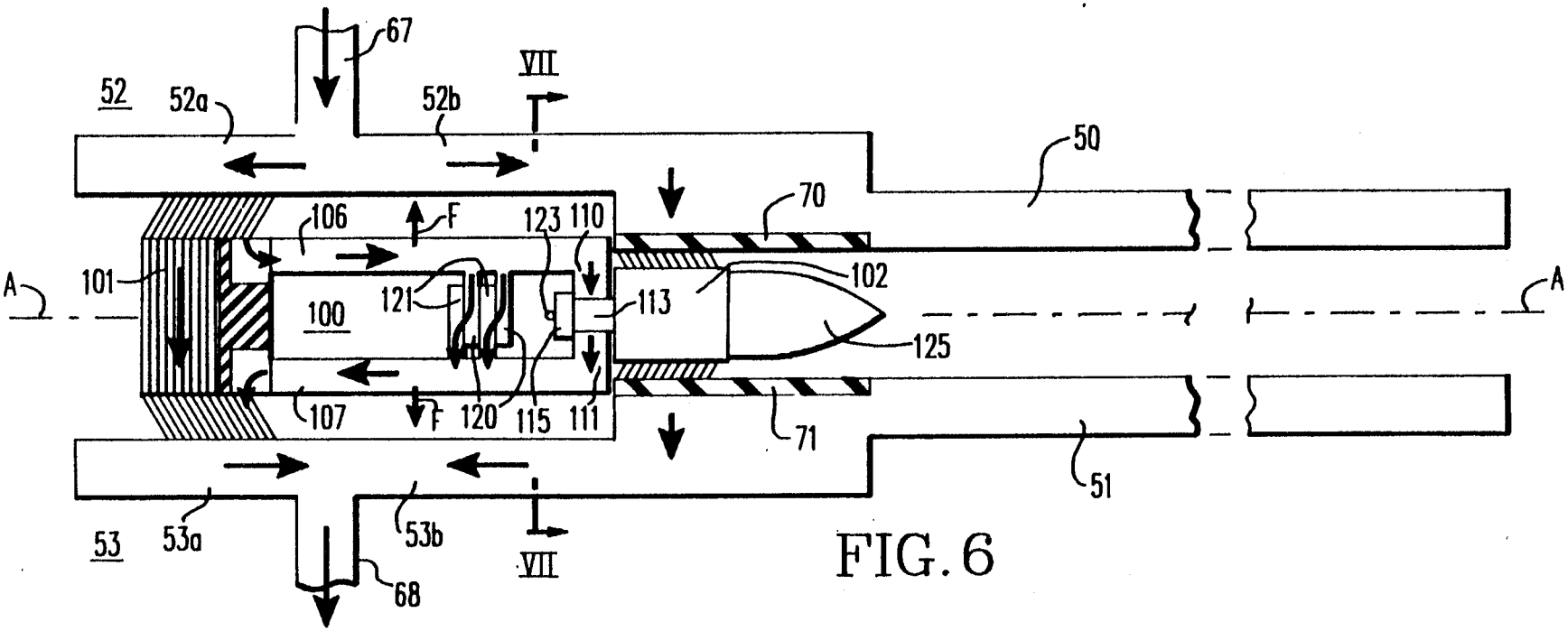
FIG. 6 illustrates another embodiment of the present invention.

FIG. 6 illustrates another embodiment of the present invention utilizing an armature assembly which does not rely on a fracture principal.

Figure 6A:
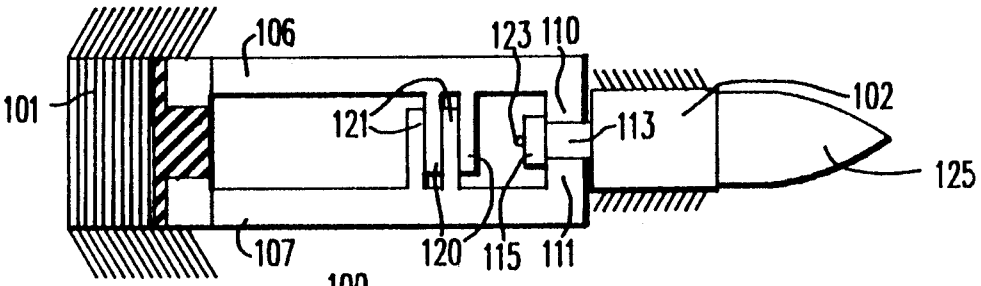
FIG. 6A illustrates an armature assembly by itself.

The armature assembly 100 (also shown separately in FIG. 6A) includes a switching armature 101 for conduction of current between switch rail segments 52 and 53, and a projectile armature 102 for conduction of current between projectile rails 50 and 51. The armatures are joined by means of relatively movable retaining busbars 106 and 107 having first ends connected to switch armature 101 and having at the other ends thereof respective projections 110 and 111 which engage a detent portion 113 of a rearward projection 115 of projectile armature 102.

Current flow through the system is as indicated by the arrows and it is seen that current flow between retaining busbars 106 and 107 is accomplished by two paths, one being via projections 110 and 111 in contact with projection 115, and the other through a series of interdigitated finger contacts 120 and 121 connected to respective retaining busbars 106 and 107 and being in sliding engagement with one another. Current flow through projectile armature 102 is limited by means of resistive inserts 70 and 71.

In operation, a greater portion of the current flows through switch armature 101 resulting in a backward force on the armature assembly 100. In order to prevent backward movement of the assembly, a retaining pin 123 is provided and acts as a stop against the rear surface of projection 115 of projectile armature 102.

It is seen that current flow through retaining busbar 106 is in a direction opposite to the current in retaining busbar 107. The electromagnetic force due to the current flowing in opposite directions in the retaining busbars 106 and 107 tend to repel the retaining busbars with a certain force in opposite directions as indicated by the arrows F. This force is augmented by the fact that the current in retaining busbar 106 is in the same direction as the current in switch rail segment 52*b*. Similarly, the current in retaining busbar 107 is in the same direction as the current in switch rail segment 53*b*, thereby generating an attracting force. When a certain current level is attained, the retaining busbars 106 and 107 will have separated by a certain amount such that projections 110 and 111 disengage from detent portion 113 thus allowing backward travel of switch armature 101 and forward travel of projectile armature 102 along with projectile 125. After exiting of the switch rail system by armature 101, full current from the power supply will be commutated into armature 102.

Figure 7:
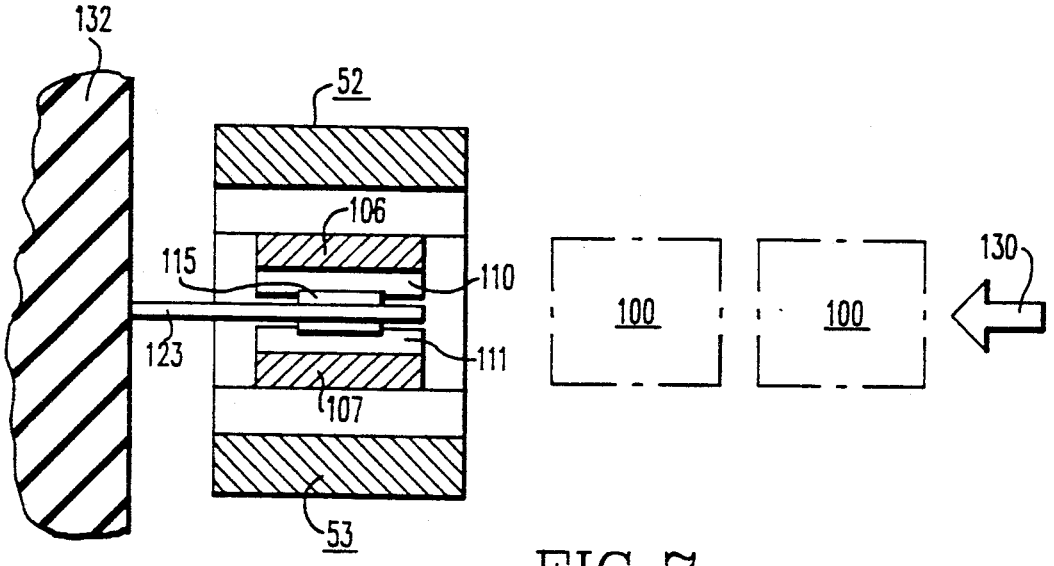
FIG. 7 illustrates a view of FIG. 6 taken along lines VII—VII.

FIG. 7 is a view along line VII—VII of FIG. 6 and illustrates the side loading capability of multiple armature assemblies for rapid fire operation. As was the case with respect to FIG. 5, a load mechanism (not illustrated) would move the armature assemblies 100, in the direction indicated by arrow 130 into the firing position between the rail systems. FIG. 7 also illustrates the retaining pin 123 as being cantilevered from an insulating sidewall structure, a portion of which, 132, is illustrated.

Accordingly, there has been described electromagnetic launcher apparatus which can be operated in a rapid fire mode and which eliminates conventional switches. Although the invention has been described by way of example with respect to metallic armatures, well known plasma armatures can also be utilized with a plasma initiating fuse being positioned in an appropriate holder.

We claim:

1. Electromagnetic projectile launcher apparatus, comprising:

A) a first set of first and second generally parallel rails constituting projectile rails;

B) a second set of first and second generally parallel rails constituting switch rails;

C) said first and second sets of rails lying along a common longitudinal axis;

D) an armature assembly including i) a first current conducting armature positioned between said projectile rails, for launching a projectile;

ii) a second current conducting armature positioned between said switch rails;

E) said first and second armatures being separably connected to one another;

F) means for providing a high current to said first and second sets of rails;

G) resistive inserts connected to said projectile rails in the vicinity of said first armature to initially limit the supplied current therethrough; and H) said armature assembly and said rails being constructed and arranged that when supplied with said current, said armatures are relatively forced in opposite directions until such time that said current reaches a magnitude of sufficient value to cause separation of said armatures whereby they are propelled in opposite directions along said axis.

2. Apparatus according to claim 1 which includes:

A) retaining means for preventing relative opposite movement of said first and second armatures when supplied with current of less than said sufficient magnitude.

3. Apparatus according to claim 1 wherein:

A) said armature assembly includes a rod connecting said first and second armatures;

B) said rod lying along said longitudinal axis.

4. Apparatus according to claim 3 wherein:

A) the connection of said rod with one of said armatures includes a weakened portion to promote separation upon attainment of said current of sufficient magnitude.

5. Apparatus according to claim 4 wherein:

A) said weakened portion connection is with said first armature.

6. Apparatus according to claim 1 which includes:

A) an arc chamber connected to the ends of said switch rails.

7. Apparatus according to claim 6 which includes:

A) means for stopping movement of said second armature after passing said arc chamber.

8. Apparatus according to claim 1 which includes:

A) means for rapidly loading a subsequent armature assembly into a position for launching, between said rails, just prior to the exiting from said projectile of said first armature of a previous armature assembly.

* * * * *